US009343849B2

(12) United States Patent
Eom et al.

(10) Patent No.: US 9,343,849 B2
(45) Date of Patent: May 17, 2016

(54) ELECTRONIC DEVICE AND INTERFACE CONNECTOR

(71) Applicant: Samsung Electronics Co., Ltd, Gyeonggi-do (KR)

(72) Inventors: Sang-Jin Eom, Gyeonggi-do (KR); Kyung-Moon Seol, Gyeonggi-do (KR); Jae-Hee Kim, Gyeonggi-do (KR); Hae-Yeon Kim, Suwon-si (KR); Jin-Kyu Bang, Gyeonggi-do (KR); Se-Hyun Park, Gyeonggi-do (KR); Joon-Ho Byun, Gyeonggi-do (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 62 days.

(21) Appl. No.: 13/963,935

(22) Filed: Aug. 9, 2013

(65) Prior Publication Data

US 2014/0045375 A1 Feb. 13, 2014

(30) Foreign Application Priority Data

Aug. 10, 2012 (KR) ..... 10-2012-0087821

(51) Int. Cl.

| | |
|---|---|
| ***H01R 13/648*** | (2006.01) |
| ***H01R 13/6594*** | (2011.01) |
| ***H01R 13/6596*** | (2011.01) |
| *H01R 13/6593* | (2011.01) |

(52) U.S. Cl.

CPC ..... *H01R 13/648* (2013.01); *H01R 13/6594* (2013.01); *H01R 13/6596* (2013.01); *H01R 13/6593* (2013.01)

(58) Field of Classification Search

CPC ..... H01R 13/6593
USPC ..... 439/607.55, 607.56, 607.57, 607.58, 439/607.27

See application file for complete search history.

(56) References Cited

U.S. PATENT DOCUMENTS

| | | | | |
|---|---|---|---|---|
| 5,797,770 | A * | 8/1998 | Davis et al. | 439/607.27 |
| 5,980,320 | A * | 11/1999 | Slack et al. | 439/607.27 |
| 6,264,504 | B1 * | 7/2001 | Wu | 439/607.27 |
| 6,863,569 | B2 * | 3/2005 | Zhu et al. | 439/607.27 |
| 8,052,467 | B1 * | 11/2011 | Xie et al. | 439/607.27 |
| 8,154,470 | B2 * | 4/2012 | Chang et al. | 343/906 |
| 8,217,853 | B2 * | 7/2012 | Tai et al. | 343/906 |
| 8,360,808 | B2 * | 1/2013 | Tsuchiya | 439/607.27 |
| 8,636,545 | B2 * | 1/2014 | Chow et al. | 439/607.27 |
| 2012/0026672 | A1 | 2/2012 | Yu et al. | |

* cited by examiner

*Primary Examiner* — Tho D Ta

(57) ABSTRACT

An interface connector includes a connection terminal unit configured to be connected with an external connector, and a metallic shell configured to enclose the connection terminal unit. The metallic shell includes a first shell unit, in which the connection terminal unit is mounted, and which is grounded with a printed circuit board, and a second shell unit mounted to be separated and spaced from the first shell unit. An electronic device comprises a connection terminal unit configured to be connected with an external connector and a metallic shell configured to enclose the connection terminal unit, wherein the metallic shell comprises a first shell unit in which the connection terminal unit is mounted, and a second shell unit mounted to be separated and spaced from the first shell unit.

19 Claims, 5 Drawing Sheets

ELECTRONIC DEVICE AND INTERFACE CONNECTOR

CROSS-REFERENCE TO RELATED APPLICATION(S) AND CLAIM OF PRIORITY

The present application is related to and claims priority under 35 U.S.C. §119(a) to Korean Application Serial No. 10-2012-0087821, which was filed in the Korean Intellectual Property Office on Aug. 10, 2012, the entire content of which is hereby incorporated by reference.

TECHNICAL FIELD

The present disclosure relates to an interface connector and an electronic device with the interface connector, and more particularly to an interface connector capable of minimizing an influence on radiation performance deterioration of an antenna provided at a peripheral area, and securing an antenna mounting space around an interface connector.

BACKGROUND

In general, an electronic device refer to a device which allows a user to enjoy various contents while carrying the devices, for example, a portable terminal, an MP3 player, a PMP (Portable Multimedia Player: PMP), an electronic book, etc. In particular, a portable terminal, more specifically a portable terminal which is commonly called a "smart phone" is integrated with various functions. Such a portable terminal is supported by various kinds of wireless mobile communication services using a frequency band, in addition to a design trend, which allows consumers to use the portable terminal conveniently, provides an elegant design for the portable terminal, and reduces the thickness of the portable terminal. Such a portable terminal is mounted with an interface connector in the inside thereof to be connected with an external connector.

However, since such a portable terminal is reduced in thickness while being provided with a screen with an increased size, and is mounted with many parts, such as a speaker, a vibrator, a microphone, an interface connector, an antenna, and the like, in the inside thereof, the space for mounting the components becomes narrow, and the parts are mounted at close positions. Accordingly, parts formed from a metallic material are mounted in close proximity to each other be close, which acts as a trigger for deteriorating performance in terms of noise and antenna radiation performance. Especially, since plural antennas or a multi-band antenna to support various frequency bands are mounted adjacent to the interface connector due to lack of mounting space, there arise problems that the interface connector deteriorates the radiation performance of the antennas, which in turn lowers the communication-related reliability of the portable terminal.

SUMMARY

Provided is an electronic device with an interface connector which can minimize the deterioration of performance of an antenna even if the interface connector is installed adjacent to the antenna.

Another aspect of the present disclosure is to provide an interface connector that enables an antenna mounting space, which has been separated due to the interface connector, to be sufficiently secured in order to secure the radiation performance of the antenna for supporting a wireless mobile communication service.

According to an aspect of the present disclosure, an interface connector includes: a connection terminal unit configured to be connected with an external connector; and a metallic shell configured to enclose the connection terminal unit, wherein the metallic shell includes a first shell unit, in which the connection terminal unit is mounted, and which is grounded with a printed circuit board, and a second shell unit mounted to be separated and spaced from the first shell unit.

In one embodiment, the metallic shell may be separated into a front part and a rear part, which are electrically separated from each other.

In another embodiment, the first shell unit may be provided behind the second shell unit to enclose the connection terminal unit, and may be grounded with the printed circuit board, and the second shell unit may be provided in front of the first shell unit.

In still another embodiment, the interface connector may further include a support unit configured to enclose the first shell unit and the second shell unit, and to fix the positions of the first shell unit and the second shell unit.

In still another embodiment, the support unit may be formed to include an injection-molded product of a non-conductive material.

In still another embodiment, the second shell unit may be provided in the support unit in an integrated type.

In still another embodiment, the second shell unit may be formed from a material different from that of the first shell unit, and an antenna pattern may be mounted to extend through the second shell unit, and an antenna is mounted in the opposite sides of the interface connector.

In still another embodiment, the second shell unit may be formed to include a metallic material, and an antenna pattern may be connected to the second shell unit in such a manner that the antenna is mounted in the opposite sides of the interface connector, whereby the second shell unit may implement a radiation performance together with the antenna.

In still another embodiment, the metallic shell may be formed to be separated into an upper part and a lower part which are electrically separated from each other.

In still another embodiment, the first shell unit may be provided on the bottom of the second shell unit, and grounded with the connection terminal unit and the printed circuit board, and the second shell unit may be provided on the top of the first shell unit, and formed from a material different from that of the first shell unit so that the second shell unit is electrically separated from the first shell unit.

In still another embodiment, the antenna pattern may extend through the top surface of the second shell unit in such a manner that the antenna its mounted in the opposite side of the interface connector.

In still another embodiment, the interface connector may further include a shield member between the first shell unit and the second shell unit, wherein the shield member is configured to connect the first shell unit and the second shell unit, and to electrically separate the first shell unit and the second shell unit from each other.

In still another embodiment, the shield member may be provided, on one side thereof, with a first engagement surface part that is configured to be engaged in the first shell unit, and on the other side, a second engagement surface part that is configured to be engaged in the second shell unit.

Before undertaking the DETAILED DESCRIPTION below, it may be advantageous to set forth definitions of certain words and phrases used throughout this patent document: the terms "include" and "comprise," as well as derivatives thereof, mean inclusion without limitation; the term "or," is inclusive, meaning and/or; the phrases "associated with" and "associated therewith," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, or the like; and the term "controller" means any device, system or part thereof that controls at least one operation, such a device may be implemented in hardware, firmware or software, or some combination of at least two of the same. It should be noted that the functionality associated with any particular controller may be centralized or distributed, whether locally or remotely. Definitions for certain words and phrases are provided throughout this patent document, those of ordinary skill in the art should understand that in many, if not most instances, such definitions apply to prior, as well as future uses of such defined words and phrases.

BRIEF DESCRIPTION OF THE DRAWINGS

For a more complete understanding of the present disclosure and its advantages, reference is now made to the following description taken in conjunction with the accompanying drawings, in which like reference numerals represent like parts.

DETAILED DESCRIPTION

Figure 1:
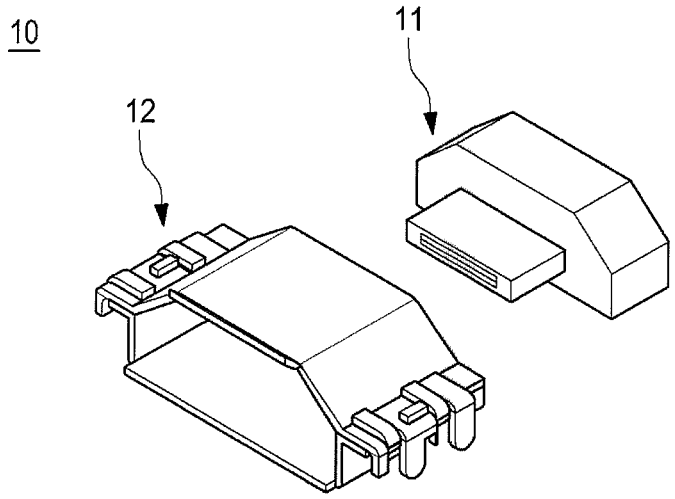
FIG. 1 is a diagram briefly illustrating a interface connector in a disassembled state.

FIGS. 1 through 11, discussed below, and tale various embodiments used to describe the principles of the present disclosure in this patent document are by way of illustration only and should not be construed in any way to limit the scope of the disclosure. Those skilled in the art will understand that the principles of the present disclosure may be implemented in any suitably arranged electronic devices. Hereinafter, various embodiments of the present disclosure will be described with reference to the accompanying drawings. In this connection, the lines and components may be exaggeratedly illustrated in terms of thickness and size in the drawings for the clarity and convenience of description. In addition, the terminologies in the following description are those defined in consideration of functions in the present disclosure, and may be changed according to an intention of a user or an operator, or a practice. Thus, the definitions for those terminologies should be determined based on the contents provided in the entirety of the present disclosure. Furthermore, although ordinal numbers, such as first and second, are used in the examples of the present disclosure described below merely to differentiate the objects with the same name from each other, the order of the objects may be arbitrarily determined and a preceding description may be applied to a postfix element.

Figure 2:
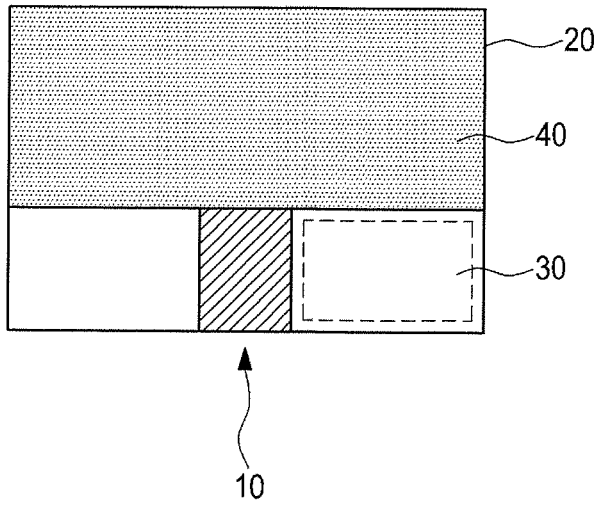
FIG. 2 is a diagram briefly illustrating a state in which the interface connector of FIG. 1 is mounted in a portable terminal.

FIG. 1 briefly illustrates an interface connector, and FIG. 2 briefly illustrates the interface connector of FIG. 1 in a state in which it is mounted in a portable terminal. Referring to FIGS. 1 and 2, the interface connector 10 is an integrated interface connector 10 configured such that one or more interface standards are polysynthetically applicable thereto, in which the interface connector 10 serves as an external connection device to communicate with an external device or to be connected with a power supply device so as to supply power. The interface connector 10 includes a connection terminal unit 11 to be connected with an external connector, and a metallic shell 12 for enclosing a connection terminal unit 11. Such an interface connector 10 is mounted in the inside of a portable terminal 20, and connected to the outside through a lateral side of the portable terminal 20 to be capable of being connected with external connectors. Specifically, the interface connector 10 is provided on the bottom of the portable terminal 20, and mounted to be connected with the outside. Such an interface connector 10 is provided at the center of the bottom side as illustrated in FIG. 2 considering the slimming of portable terminal 20 and characteristics between mounted parts.

Figure 9:
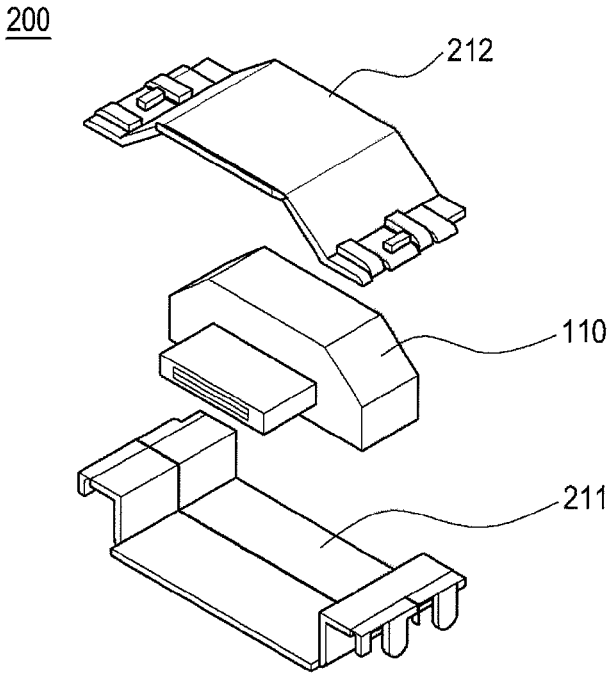
FIG. 9 is a diagram briefly illustrating the configuration of an interface connector according to another exemplary embodiment of the present disclosure in a disassembled state.
Figure 10:
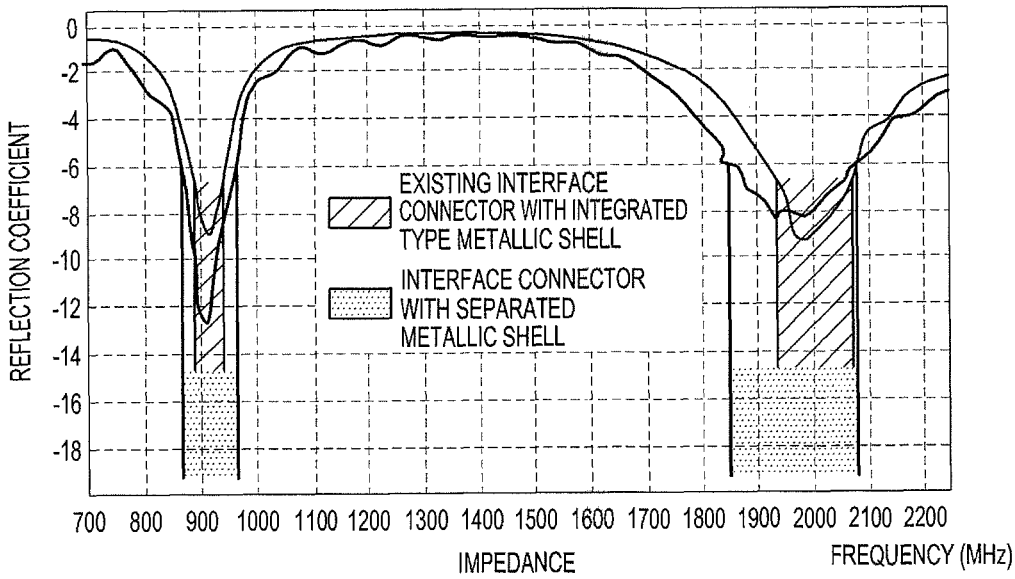
FIG. 10 is a graph illustrating fluctuations in terms of impedance in an interface connector in which a separated metallic shell is provided as in the exemplary embodiments of the present disclosure, and in an interface connector in which an integrated type metallic shell is provided.
Figure 11:
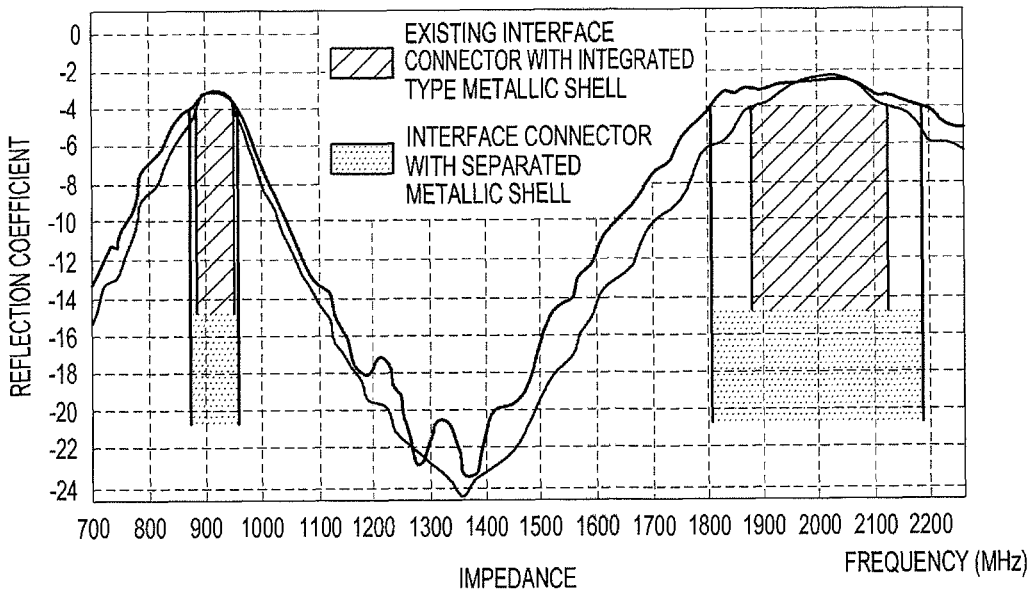
FIG. 11 is a graph illustrating fluctuations in terms of efficiency in the interface connector in which a separated metallic shell is provided as in the exemplary embodiments of the present disclosure, and in the interface connector in which an integrated type metallic shell is provided.

Now, the exemplary interface connectors according to the present disclosure will be described with reference to FIGS. 3 to 11. For reference. FIGS. 3 to 8 illustrate an exemplary embodiment of the inventive interface connector, and FIG. 9 illustrates another exemplary embodiment of the inventive interface connector. Briefly, there is a difference between the exemplary embodiment of the interface connector illustrated in FIGS. 3 to 8 and the exemplary embodiment of the interface connector illustrated in FIG. 9 in that the former is provided with a metallic shell which is separated into a front part and a rear part, and the latter is provided with a metallic shell which is separated into an upper part and a lower part. In addition, FIG. 10 is a graph illustrating fluctuations in terms of impedance in an interface connector in which a separated metallic shell is provided as in the exemplary embodiments of the present disclosure, and in a interface connector in which an integrated type metallic shell is provided, and FIG. 11 is a graph illustrating fluctuations in terms of efficiency obtained thereby.

Figure 3:
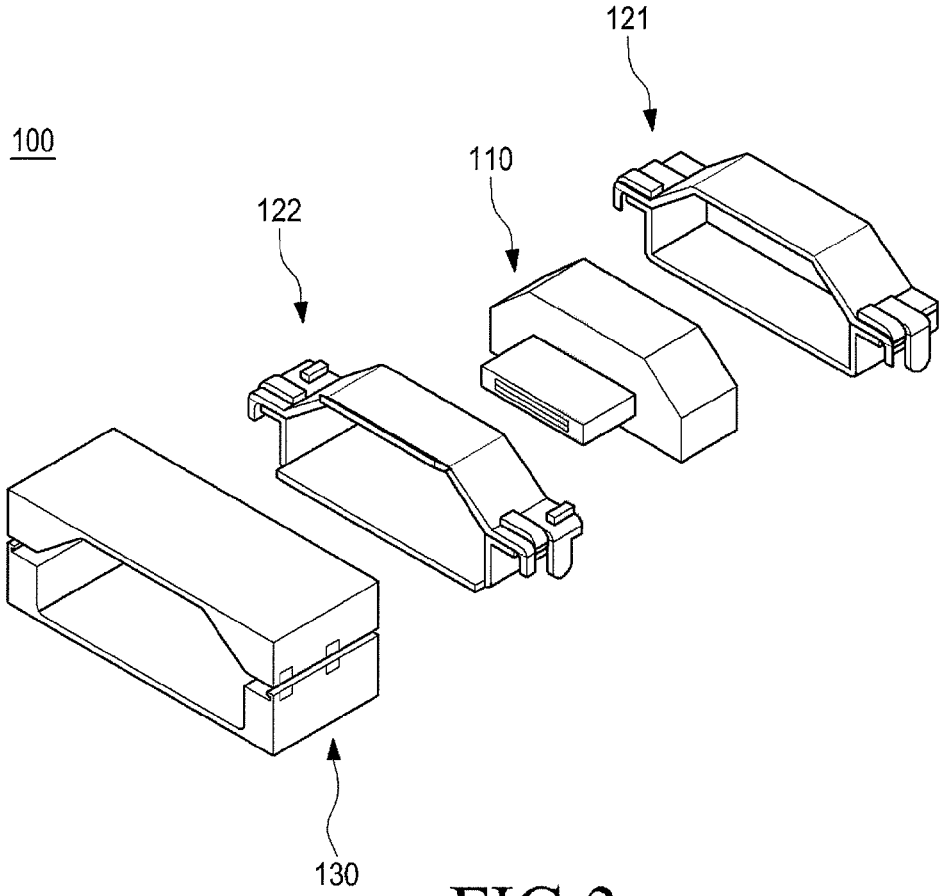
FIG. 3 is a diagram briefly illustrating an interface connector according to an exemplary embodiment of the present disclosure in a disassembled state.
Figure 4:
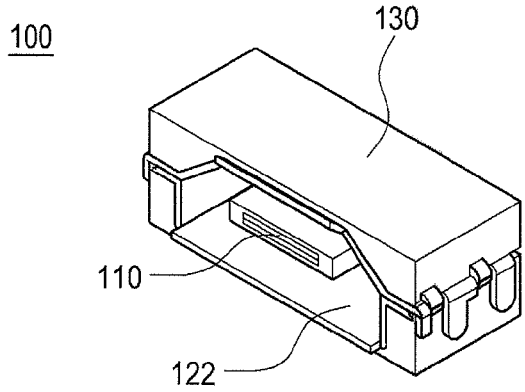
FIG. 4 is a diagram illustrating the interface connector of FIG. 3 in the assembled state.

At first, an interface connector according to an exemplary embodiment of the present disclosure will be described with reference to FIGS. 3 to 8. FIG. 3 is a diagram briefly illustrating an interface connector according to an exemplary embodiment of the present disclosure in a disassembled state, and FIG. 4 is a diagram illustrating the interface connector of FIG. 3 in the assembled state. Referring to FIGS. 3 and 4, the inventive interface connector 100 includes a connection terminal unit 110, a metallic shell, and a support unit 130. The connection terminal unit 110 is a connection device, to which an external connector is connected for charging, data transmission, etc. Such a connection terminal unit 110 can have a shape according to an interface standard determined according to a standard of a portable terminal 50 or an external connector (not illustrated). For example, the connection terminal unit 110 can be formed to be suitable for a standard, such as a 12 pin standard, a 24 pin standard or the like. The connection terminal unit 110 is electrically connected with a printed circuit board 70, which is electrically connected with a first shell unit 121 to be described later and mounted in the inside of a portable terminal 50 or the like together with the first shell unit 121.

The metallic shell is formed to enclose the connection terminal unit 110 to cover and support the connection terminal unit 110, and, when an external connector is connected with the connection terminal unit 110, to support the external connector and connection terminal unit 110. In addition, the metallic shell is formed with an opening at a side thereof so that the external connector can extend through the side to be connected to the connection terminal unit 110. The metallic shell, which encloses the connection terminal unit 110, is configured to be separated and partitioned into two stages, in which the metallic shell is formed to be separated into a front part and a rear part, which are electrically separated from each other, as illustrated in FIG. 3. That is, the metallic shell is divided into a first shell unit 121 and a second shell unit 122 separated and spaced from first shell unit 121.

Figure 5:
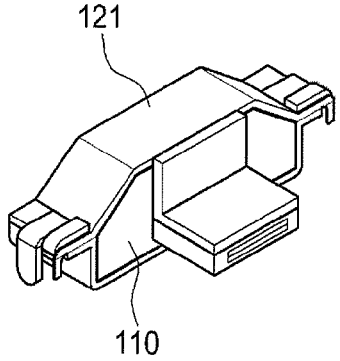
FIG. 5 is a diagram illustrating a state in which a connection terminal unit is mounted in the first shell unit in the interface connector of FIG. 4 to be grounded.

FIG. 5 is a diagram illustrating a state in which the connection terminal unit is mounted in the first shell unit in the interface connector of FIG. 4 to be grounded. Referring to FIG. 5, the first shell unit 121 is provided behind the second shell unit 122, and is equipped with the connection terminal unit 110 therein, in which the first shell unit 121 is configured to be electrically connected with the connection terminal unit 110 and a printed circuit board 70. The second shell unit 122 is mounted to be spaced from the front face of the first shell unit 121 and forms an opening, so that the external connector extends through the opening to be connected with the connection terminal unit 110 and to be supported in the opening. In the present exemplary embodiment, it is described that the metallic shell, which is separated into the spaced front and rear part by way of an example, and also described that among the separated components, only the first shell unit 121 is electrically connected with the connection terminal unit 110 and the printed circuit board 70. However, the separating direction of the metallic shell is not limited to this, and of course, the separated and spaced form can be variously modified. For example, as in another exemplary embodiment to be described later, the metallic shell can be constituted with upper and lower parts which are formed from different materials and electrically separated from each other.

Meanwhile, the first shell unit 121 and the second shell unit 122 can be formed from the same metallic material or from different materials. When the first shell unit 121 and the second shell unit 122 are formed from a metallic material, the second shell unit 122 is configured to be separated and spaced from the first shell unit 121 such that electricity cannot be conducted to the second shell unit 122.

Figure 6:
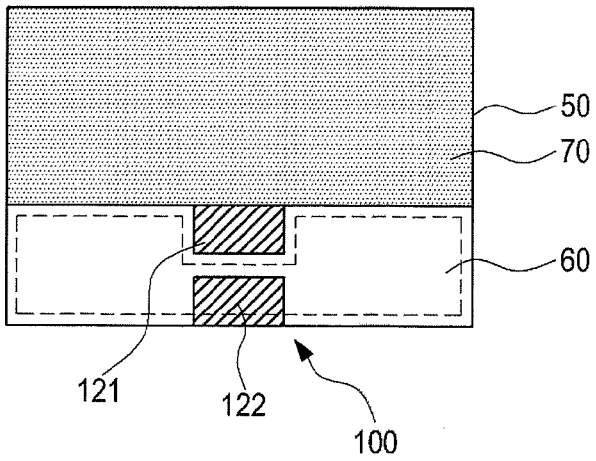
FIG. 6 is a diagram briefly illustrating a state in which the interface connector of FIG. 4 is mounted in a portable terminal, and an antenna is mounted in this connection.

FIG. 6 is a diagram briefly illustrating a state in which the interface connector of FIG. 4 is mounted in a portable terminal, and an antenna is mounted in this connection. Referring to FIG. 6, when the interface connector 100 is mounted in the inside of the portable terminal 50 together with an antenna 60 or the like, it is possible to mount the antenna 60 to extend through the interface connector 100, more specifically the second shell unit 122, and it is also possible to mount the antenna 60 to extend between the first shell unit 121 and the second shell unit 122. As a result, the antenna 60 is enabled to be mounted in the opposite sides of the interface connector 100, which makes it possible to improve the radiation performance antenna 60 as well as to secure a wider space for mounting the antenna 60.

Figure 7:
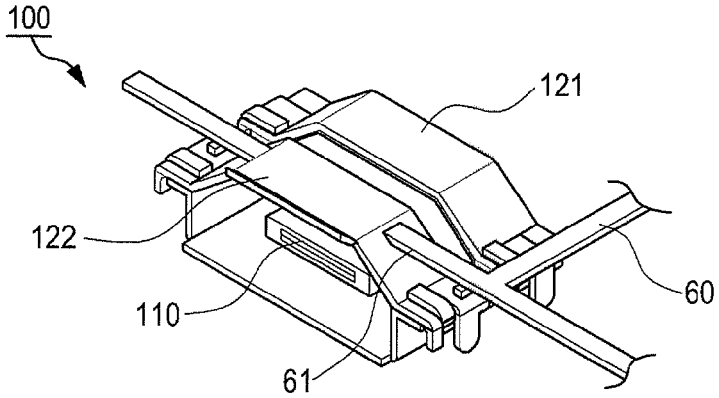
FIG. 7 is a diagram briefly illustrating how the second shell unit in FIG. 4 is connected with an antenna pattern to implement a radiation function with the antenna.

In addition, FIG. 7 is a diagram briefly illustrating how the second shell unit in FIG. 4 is connected with an antenna pattern to implement a radiation function with the antenna. Referring to FIG. 7, in a case where the second shell unit 122 is formed from a metallic material, when an antenna pattern 61 is connected to the opposite sides of the second shell unit 122, the second shell unit 122 can be used as a part of the configuration of the antenna 60. Therefore, the antenna 60 can be mounted in the opposite sides of the interface connector 100 and the second shell unit 122 can function as the antenna 60, whereby the interface connector 10 can implement the radiation function together with the antenna 60.

Figure 8:
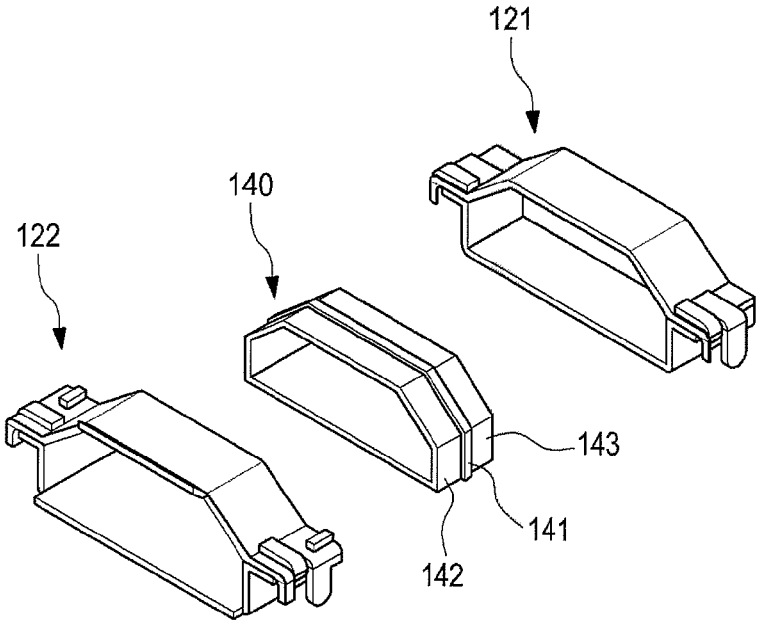
FIG. 8 is a diagram briefly illustrating a shield member further configured between the first shell unit and second shell unit illustrated in FIG. 4.

FIG. 8 is a diagram briefly illustrating a shield member further configured between the first shell unit and second shell unit illustrated in FIG. 4. Referring to FIG. 8, in case where the first shell unit 121 and the second shell unit are formed from the same metallic material, the first and second shell units 121 and 122 can be connected to be engaged with each other, and a shield member 140 can be provided between the first shell unit 121 and the second shell unit 122 so that electricity cannot be conducted between the first shell unit 121 and the second shell unit 122. That is, the first shell unit 121 and the second shell unit 122 are partitioned by the shield member 140 formed from, for example, a plastic material, such that electricity, which is conducted to the first shell unit 121, cannot be conducted to the second shell unit 122. Referring to the shape of the shield member 140, the shield member 140 has a partitioning surface 141 that forms a surface flush with the first and second shell units 121 and 122 between the first and second shell units 121 and 122 and separately partitions the first and second shell unit 121 and 122, and first and second engagement surface parts 143 and 142 that extend from the opposite sides of the partitioning surface 141 to be engaged in the first and second shell units 121 and 122, respectively. Thus, it is possible to implement a configuration in which the first and second shell units 121 and 122 are coupled to each other but are electrically shielded from each other by the shield member 140. Although in the present exemplary embodiment, a configuration of the shield member 140 is described by way of an example, various modifications in form can be made. For example, the first and second shell units 121 and 122 can be configured to be electrically separated and separated from each other without configuring the shield member 140, and the first and second shell unit 121 and 122 can be formed from different materials.

In addition, the first shell unit 121 and the second shell unit 122 can be formed from different materials. Specifically, the first shell unit 121 can be formed to include an electrically conductive metallic material to be electrically connected with the connection terminal unit 110 and the printed circuit board 70, and the second shell unit 122 can be formed from a electrically non-conductive material, such as a plastic material. Therefore, the first and second shell units 121 and 122 are configured such that even if the first shell unit 121 and the second shell unit 122 are coupled to each other, electricity is not conducted to the second shell unit 122. As a result, even if the antenna 60 extends through the second shell unit 122 (see FIG. 6), the radiation of the antenna 60 is not affected. Rather, since the antenna 60 can be mounted through the second shell unit 122, the radiation performance of the antenna 60 can be improved.

The support unit 130 is configured to seat and fix the first shell unit 121 and the second shell unit 122. The support unit 130 includes an injection-molded product of a non-conductive material, and the interface connector 100 is mounted in an electronic device, such as a portable terminal 50, and provided not to influence the radiation function of the antenna 60 mounted in the electronic device. The second shell unit 122 can be provided in a type integrated with such a support unit 130. When the second shell unit 122 is formed in the type integrated with the support unit 130, the first shell unit 121, in which the connection terminal unit 110 is mounted, is mounted in the support unit 130 to be separated and spaced from the second shell unit 122.

Therefore, the interface connector 100 according to the present exemplary embodiment is configured in such a manner that the metallic shell is separated into a part that is electrically connected with the connection terminal unit 110 (the first shell unit 121 in the present exemplary embodiment), and a part that encloses the connection terminal unit 110 but is not electrically connected with the connection terminal unit 110 (the second shell unit 122 in the present exemplary embodiment), thereby allowing the antenna pattern 61 to extend through the interface connector 100. As a result, various advantages can be obtained in that the space for mounting the antenna 60 can be expanded to the opposite sides of the interface connector 100, and the radiation performance of the antenna 60 can be prevented from being deteriorated. FIG. 10 is a graph illustrating fluctuations in terms of impedance in an interface connector in which a separated metallic shell is provided as in the exemplary embodiments of the present disclosure, and in an interface connector in which an integrated type metallic shell is provided, and FIG. 11 is a graph illustrating fluctuations in terms of efficiency obtained thereby. Referring to FIGS. 10 and 11, it can be confirmed that when a separated metallic shell 100 is provided, the impedance frequency band can be widened, and the radiation performance of the antenna 60 can be also improved.

The interface connector 100 according to another exemplary embodiment of the present disclosure will be described with reference to FIG. 9. The difference between the present exemplary embodiment and the above-mentioned exemplary embodiment is the separated shape of the metallic shell 200, and the other configurations are the same with those of the above-mentioned exemplary embodiment. Therefore, the present exemplary embodiment will be described only focused on the difference, and the description for the other configurations and actions in the description of the above-mentioned embodiment shall apply in the present exemplary embodiment.

In the present exemplary embodiment, the metallic shell 200 is formed to be separated into an upper part and a lower part, which are formed from different materials in such a manner that one of the upper part and lower part is formed to be electrically conductive, and the other is formed from an electrically non-conductive material. Therefore, the upper and lower parts, which are separated from each other in the metallic shell 200, are formed to be electrically separated from each other. More specifically, the metallic shell 200 includes a first shell unit 211 mounted in the bottom part, and a second shell unit 212 mounted in the top of the first shell unit 211. The first shell unit 211 is provided on the bottom of the second shell unit 212 and configured to be grounded with the connection terminal unit 110 and printed circuit board 70, in which the first shell unit 211 includes a metallic material. The second shell unit 212 is configured to be installed on the first shell unit 211, and includes a material, which is different from that of the first shell unit 211, more specifically a non-conductive material, so that the second shell unit 212 is not electrically conductive with the first shell unit 211. As a result, when the antenna 60 is provided in the opposite sides of the interface connector 100, the antenna 60 can be mounted to extend through the top part of the second shell unit 212 provided on the top of the first shell unit 212, which makes it possible to secure the height of the antenna 60. In addition, even if the pattern of the antenna 60 extends through the second shell unit 212, the interface connector 100 does not influence the radiation performance of the antenna 60. As a result, it is possible to secure the space for mounting the antenna 60, and to improve the radiation efficiency of the antenna 60.

In accordance with the present disclosure, when a metallic shell is formed to be separated, it is possible to minimize the deterioration of the radiation performance of an antenna which is affected by a metallic material.

In addition, with the metallic shell is separated, an antenna pattern can be positioned in a second shell unit side which is separated from a first shell unit which is electrically connected with a printed circuit board. As a result, an antenna can be mounted in the opposite side of the interface connector, thereby securing a sufficient space for mounting the antenna, and an antenna radiation performance can be secured by securing the antenna mounting space.

In addition, when the electrically separated second shell unit among the separated metallic shell units is formed from a metallic material, the second shell unit can also have a radiation function like the antenna by connecting the antenna pattern to the second shell unit, whereby the antenna radiation performance can be improved.

Although the present disclosure has been described with an exemplary embodiment, various changes and modifications may be suggested to one skilled in the art. It is intended that the present disclosure encompass such changes and modifications as fall within the scope of the appended claims.

What is claimed is:

1. An interface connector comprising:

a connection terminal unit configured to connect with an external connector; and a metallic shell configured to enclose the connection terminal unit, wherein the metallic shell comprises a first shell unit in which the connection terminal unit is mounted, and a second shell unit configured to be separated and spaced from the first shell unit when mounted, and wherein an antenna pattern is connected to the second shell unit, and wherein the antenna pattern is connected to the second shell unit in such a manner that the antenna pattern is mounted in the opposite sides of the interface connector whereby the second shell unit implements a radiation performance together with an antenna.

2. The interface connector of claim 1, wherein the first shell unit is grounded with a printed circuit board.

3. The interface connector of claim 1, wherein the metallic shell is separated into a front part and a rear part that are electrically separated from each other.

4. The interface connector of claim 3, wherein the first shell unit is provided behind the second shell unit to enclose the connection terminal unit, and wherein the first shell unit is grounded with the printed circuit board.

5. The interface connector of claim 4, wherein the second shell unit is provided in front of the first shell unit.

6. The interface connector of claim 4, wherein the second shell unit comprises a material that is different from a material of the first shell unit.

7. The interface connector of claim 4, wherein the antenna pattern is configured to extend through the second shell unit when mounted;

wherein the interface connector further comprises an antenna mounted on opposing sides of the interface connector; and wherein the antennas disposed at both surfaces of the interface are connected by the antenna pattern mounted to extend through the second shell unit.

8. The interface connector of claim 4, wherein the second shell unit comprises a metallic material.

9. The interface connector of claim 4, further comprising a support unit configured to enclose the first shell unit and the second shell unit, and to secure positions of the first shell unit and the second shell unit.

10. The interface connector of claim 9, wherein the support unit comprises an injection-molded having a non-conductive material.

11. The interface connector of claim 10, wherein the second shell unit is provided in the support unit and comprises an integrated type.

12. The interface connector of claim 1, wherein the metallic shell comprises an upper part and a lower part that are configured to separate from each other and that are electrically insulated from each other.

13. The interface connector of claim 12, wherein the second shell unit is positioned on the top of the first shell unit, and wherein the second shell unit is formed from a material that is different than a material of the first shell unit so that the second shell unit is electrically insulated from the first shell unit.

14. The interface connector of claim 12, wherein the first shell unit is positioned on the bottom of the second shell unit, and wherein the first shell unit is grounded with the connection terminal unit and the printed circuit board.

15. The interface connector of claim 14, wherein the antenna pattern extends through a top surface of the second shell unit so that an antenna is mounted on an opposing side of the interface connector.

16. The interface connector of claim 1, further comprising a shield member positioned between the first shell unit and the second shell unit.

17. The interface connector of claim 16, wherein the shield member is configured to physically connect the first shell unit to the second shell unit, and to electrically insulate the first shell unit from the second shell unit.

18. The interface connector of claim 16, wherein a first engagement surface part is positioned on a first side of the shield member, and is configured to be engaged in the first shell unit, and wherein a second engagement surface part is position on a second side of the shield member opposite the first side of the shield member and is configured to be engaged in the second shell unit.

19. An electronic device comprising:

a connection terminal unit configured to connect with an external connector; and a metallic shell configured to enclose the connection terminal unit, wherein the metallic shell comprises a first shell unit in which the connection terminal unit is mounted, and a second shell unit configured to be separated and spaced from the first shell unit when mounted, wherein an antenna pattern is connected to the second shell unit, and wherein the antenna pattern is connected to the second shell unit in such a manner that the antennas pattern is mounted in opposite sides of an interface connector whereby the second shell unit implements a radiation performance together with an antenna.

* * * * *